US007351113B2

(12) United States Patent
Lee et al.

(10) Patent No.: US 7,351,113 B2
(45) Date of Patent: Apr. 1, 2008

(54) AUDIO JACK CONNECTOR

(75) Inventors: Shih-An Lee, Taipei Hsien (TW); Kuo-Chin Lin, Taipei Hsien (TW); Kai-Hsiang Chang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/467,121

(22) Filed: Aug. 24, 2006

(65) Prior Publication Data

US 2008/0050977 A1 Feb. 28, 2008

(51) Int. Cl.
*H01R 24/04* (2006.01)

(52) U.S. Cl. ..... 439/668
(58) Field of Classification Search ..... 439/668, 439/669, 188; 381/77
See application file for complete search history.

(56) References Cited

U.S. PATENT DOCUMENTS

| | | | | |
|---|---|---|---|---|
| 5,343,008 | A * | 8/1994 | Ipcinski | 200/302.2 |
| 5,755,592 | A * | 5/1998 | Hillbish et al. | 439/541.5 |
| 6,210,220 | B1 * | 4/2001 | Zhu et al. | 439/567 |
| 6,454,591 | B1 * | 9/2002 | Pradier et al. | 439/364 |
| 2006/0046563 | A1 * | 3/2006 | Enami et al. | 439/564 |
| 2006/0166561 | A1 * | 7/2006 | Ma | 439/668 |

* cited by examiner

*Primary Examiner*—Alexander Gilman
(74) *Attorney, Agent, or Firm*—WPAT, P.C.; Anthony King

(57) ABSTRACT

An audio jack connector includes a dielectric housing, a plurality of terminals received in the dielectric housing and a nut received in the dielectric housing too. The dielectric housing has a first body. A nut fixing means protrudes from the bottom of the first body. The nut fixing means has a main body. A nut receiving cavity is defined on one end surface of the main body. A pair of recesses are defined in the inner surface of the nut receiving cavity. A hole is formed on the other end surface of the main body. The hole communicates with the nut receiving cavity and a reacting wall is defined on where the hole communicates with the nut receiving cavity. The nut includes a second body. A pair of limbs are defined on the outer surface of the second body and engage with the recesses.

7 Claims, 7 Drawing Sheets

AUDIO JACK CONNECTOR

BACKGROUND OF THE INVENTION

1. Field of the Invention

The present invention relates to an audio jack connector, and particularly to an audio jack connector which has a nut fixing means.

2. The Related Art

The audio jack connector which transmit audio signal is widely used in electronic devices. Especially in the portable products, the audio jack connectors become a necessary part nowadays.

A conventional audio jack connector includes a dielectric housing and a plurality of terminals received in the dielectric housing. A nut fixing means protrudes from the bottom of the dielectric housing. A nut received in the nut fixing means is shaped together with the nut fixing means by insert molding design.

However, because the nut received in the fixing means is shaped together with the nut fixing means, the nut is not easy to disassemble if the nut is damaged. In this case, the whole audio jack connector will be out of use only for the nut's damage. Moreover, in the process of the audio jack connector's production, the cost of the product is increased because the insert molding design is utilized.

SUMMARY OF THE INVENTION

The objective of the present invention is to provide an audio jack connector whose assembly and disassembly are convenient and the cost of the audio jack connector is reduced.

In order to achieve the functions just as described, an audio jack connector which includes a dielectric housing, a plurality of terminals and a nut is provided. The dielectric housing has a first body. A nut fixing means protrudes from the bottom of the first body. The nut fixing means has a main body. The main body has a front surface, a rear surface, two side surfaces and a bottom surface. A nut receiving cavity is defined on the rear surface. A pair of recesses are defined in the inner surface of the nut receiving cavity. A slot is defined on the bottom surface and each side surface respectively. A hole is formed on the front surface. The hole communicates with the nut receiving cavity and a reacting wall is defined on where the hole communicates with the nut receiving cavity. The nut includes a second body which is received in the nut receiving cavity. The second body has a plugging surface. A crew receiving groove is defined in the inner of the second body. A pair of limbs are defined on the outer surface of the second body. The limbs engage with the recesses respectively. The plugging surface presses against with the reacting wall.

As described in the above, the audio jack connector utilizes the nut fixing means and the nut shaped respectively to make the nut disassembled easily so as to prevent the whole audio jack connector being out of use when only the nut of the audio jack connector is damaged.

BRIEF DESCRIPTION OF THE DRAWINGS

The exact nature of this invention, as well as other objectives and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENT

Detailed description will hereunder be given of the preferred embodiment of an audio jack connector according to the present invention with reference to the accompanying drawings.

Figure 1:
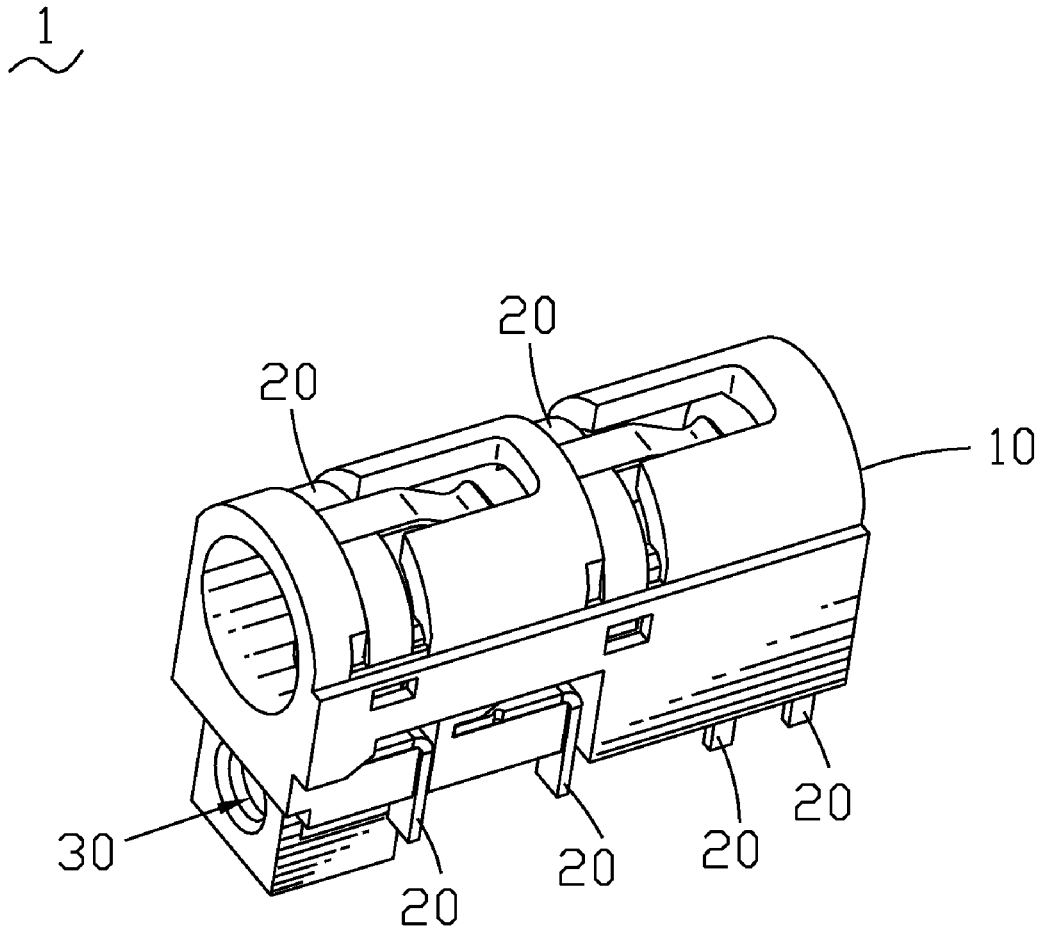
FIG. 1 is a perspective view of an audio jack connector according to the invention.
Figure 3:
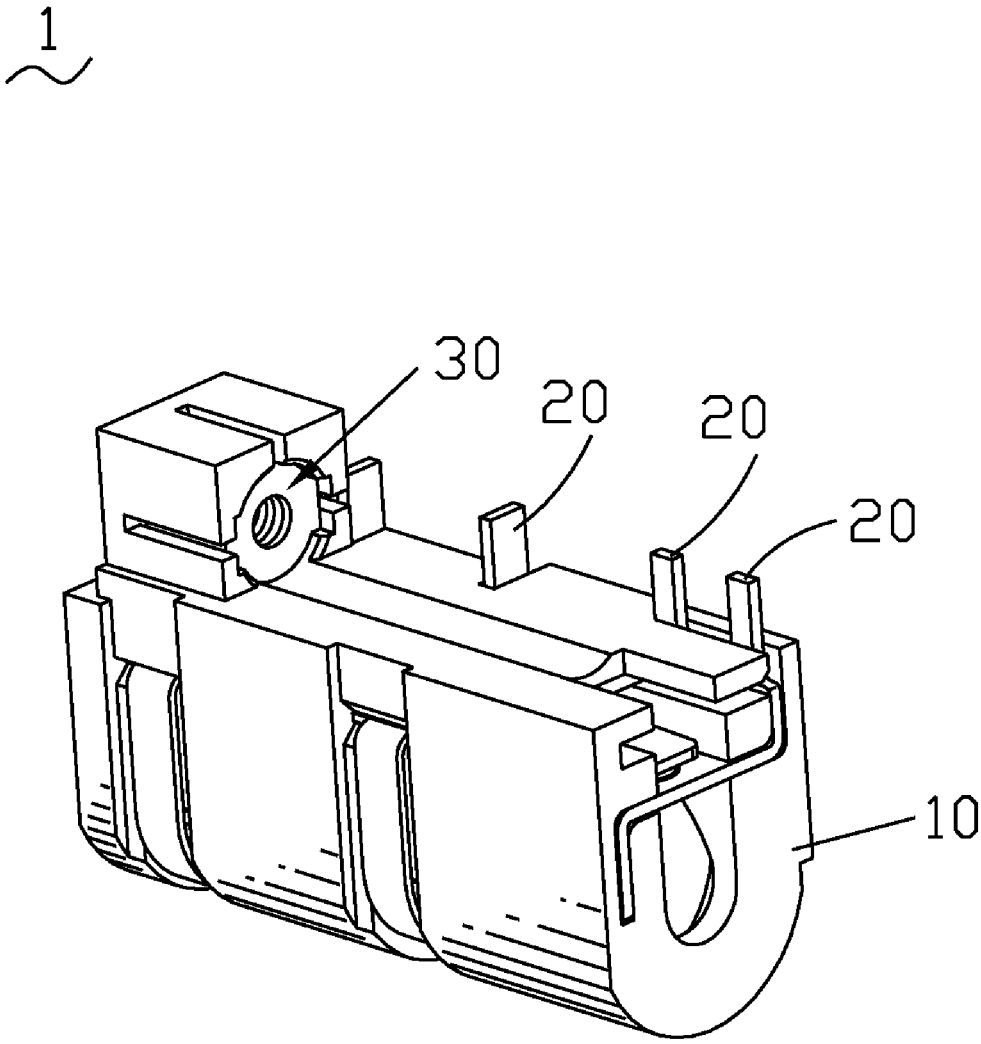
FIG. 3 is another perspective view of the audio jack connector according to the invention.

Please refer to FIG. 1 and FIG. 3. An audio jack connector 1 according to the present invention includes a dielectric housing 10, a plurality of terminals 20 which are received in the dielectric housing 10 and a nut 30 which is also received in the dielectric housing 10.

Figure 2:
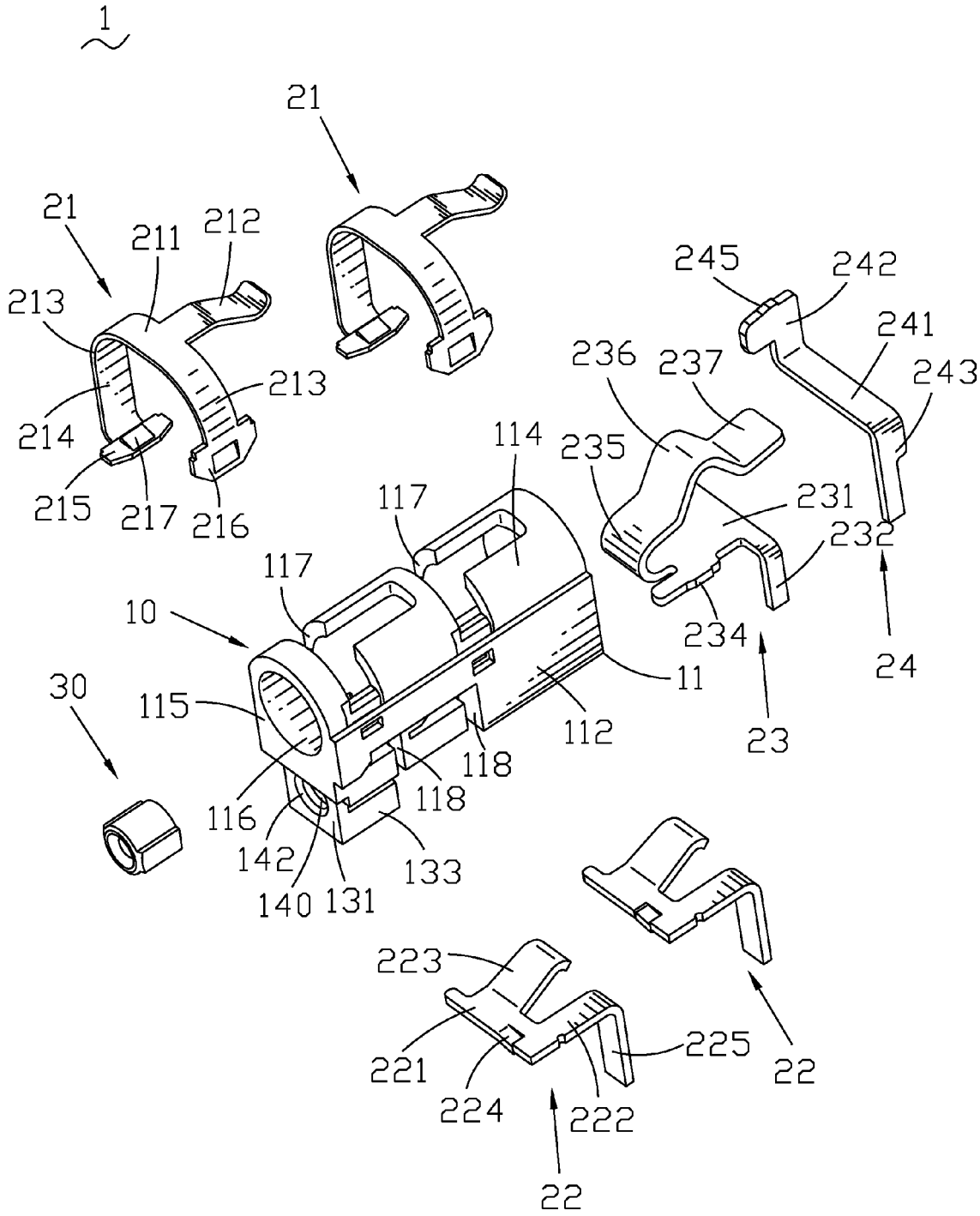
FIG. 2 is an exploded view of the audio jack connector according to the invention.
Figure 4:
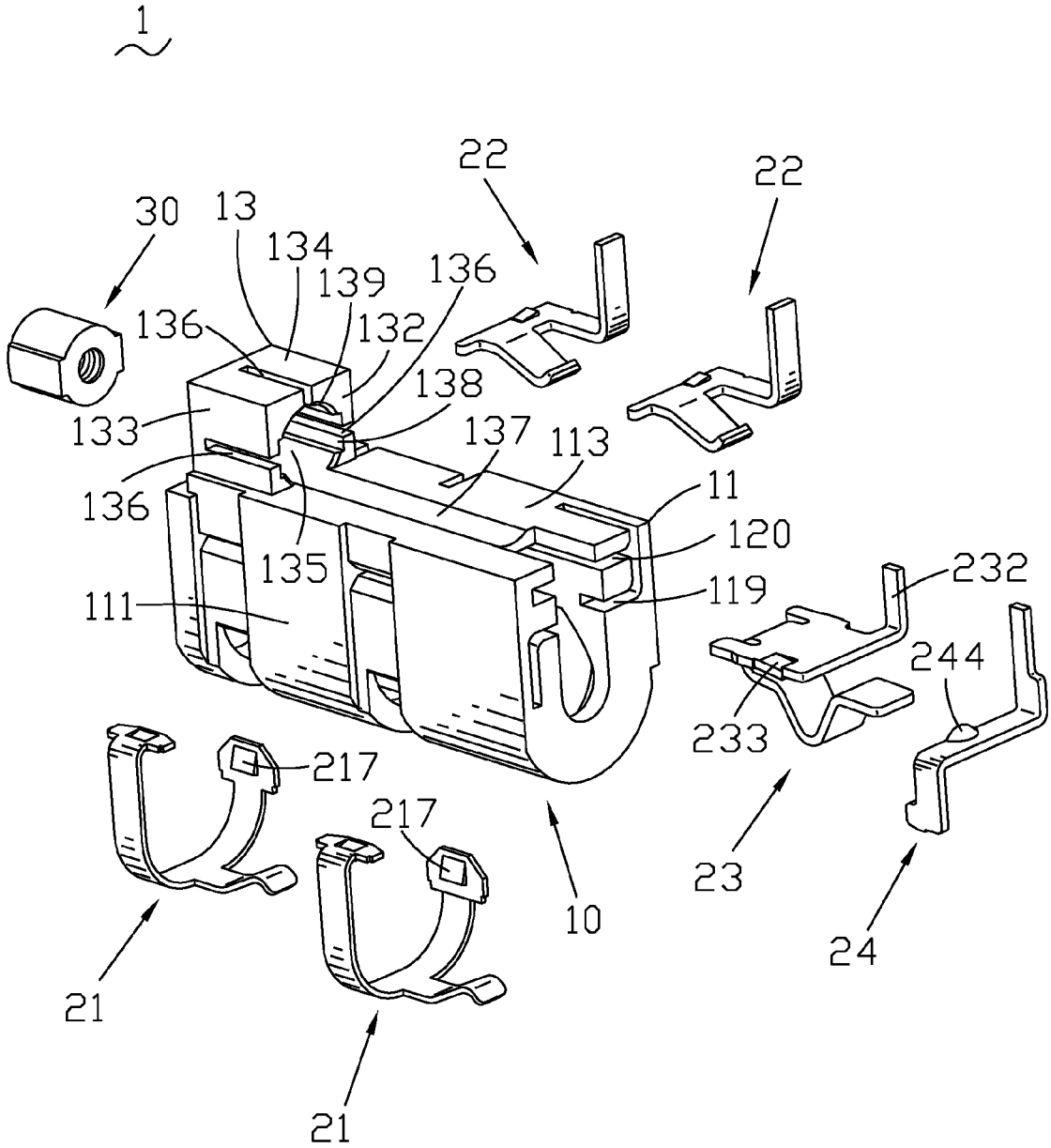
FIG. 4 is another exploded view of the audio jack connector according to the invention.

Referring to FIG. 2 and FIG. 4, the dielectric housing 10 includes a first body 11. The first body 11 is cuboid and includes a first sidewall 111, a second sidewall 112, a bottom wall 113 and a top wall 114 which is an arc wall. The first body 11 has a contact surface 115. A plug hole 116 is defined on the contact surface 115 to receive a plug (not show in figures). The plug hole 116 extends through the first body 11. A pair of first terminal receiving grooves 117 are defined on the top wall 114 and the first sidewall 111. A pair of second terminal receiving grooves 118 are defined on the bottom wall 113 and the second sidewall 112. A third terminal receiving groove 119 and a fourth terminal receiving groove 120 are formed on the back portion of the first body 11. The third terminal receiving groove 119 is upper than the fourth terminal receiving groove 120. A nut fixing means 13 protrudes from and adheres to the front portion of the bottom wall 113.

Figure 8:
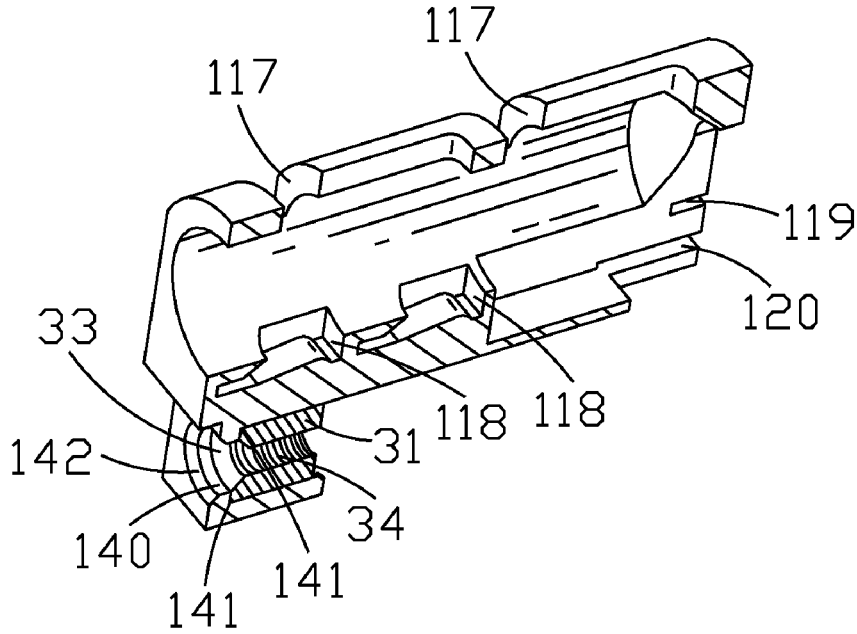
FIG. 8 is a cross-sectional view of FIG. 7 taken along VIII-VIII.

The nut fixing means 13 has a main body. The main body has a front surface 131, a rear surface 132, two side surfaces 133 and a bottom surface 134. A nut receiving cavity 135 is defined on the rear surface 132. The nut receiving cavity 135 is a cylinder and extends forwardly to the front surface 131. A slot 136 is defined on each side surface 133 and the bottom surface 134 respectively. The slots 136 communicate with the nut receiving cavity 135. An arced guide groove 137 is defined on the bottom wall 113. The nut 30 is inserted into the nut receiving cavity 135 along the guide groove 137. A pair of recesses 138 are formed in the inner surface of the nut receiving cavity 135. A first fillet portion 139 is defined around of the nut receiving cavity 135 on the rear surface 132. A hole 140 is formed in the front surface 131. The diameter of the hole 140 is smaller than the diameter of the nut receiving cavity 135 and also the hole 140 is coaxial with the nut receiving cavity 135. The hole 140 extends backwardly and communicates with the nut receiving cavity 135. A reacting wall 141 (as shown in FIG. 8) is defined on where the hole 140 communicates with the nut receiving cavity 135. A second fillet portion 142 is formed around of the front portion of the hole 140.

The terminals 20 include a pair of first terminals 21, a pair of second terminals 22 and a pair of switch terminals. The switch terminals include a movable terminal 23 and a stationary terminal 24.

Each first terminal 21 includes a first base plate 211. A first contact portion 212 extends backwardly from the first base plate 211. An arced first side arm 213 extends downwardly from the lateral sides of the first base plate 211 respectively. A second side arm 214 extends downwardly from the end of one of the first side arm 213. A first plugging portion 215 is defined on the end of the second side arm 214. A second plugging portion 216 is formed on the end of the first side arm 213. The first base plate 211, the first side arms 213 and the second side arm 214 make a fixing portion. A first projection portions 217 is formed on the upper surface of the first plugging portion 215 and the inner surface of the second plugging portion 216 respectively.

Each second terminal 22 includes a second fixing portion. The second fixing portion includes a first plate 221 which extends horizontally and a second plate 222 which extends longitudinally form one side of the first plate 221. A second contact portion 223 extends upwardly from the inner side of the first plate 221. A first buckle 224 is defined on the middle portion of the first plate 221. A first inserting portion 225 extends downwardly from the end of the second plate 222.

The movable terminal 23 includes a third fixing portion 231. A second inserting portion 232 extends downwardly from the outer side of the back portion of the third fixing portion 231. A second buckle 233 is defined on one side of the middle portion of the third fixing portion 231. A second projection portion 234 is defined on the other side of the middle portion of the third fixing portion. A connect portion 235 is formed on the front portion of the third fixing portion 231. A third contact portion 236 extends from the end of the connect portion 235. A switch portion 237 extends from the end of the third contact portion 236.

The stationary terminal 24 has a fourth fixing portion. The fourth fixing portion includes a second base plate 241 and a side plate 242 which extends upwardly from one end of the base plate 241. A third inserting portion 243 extends downwardly from the other end of the base plate 241. A compressed portion 244 is defined on the middle portion of the bottom surface of the second base plate 241. A third projection portion 245 is defined on the top of the side plate 242.

Figure 5:
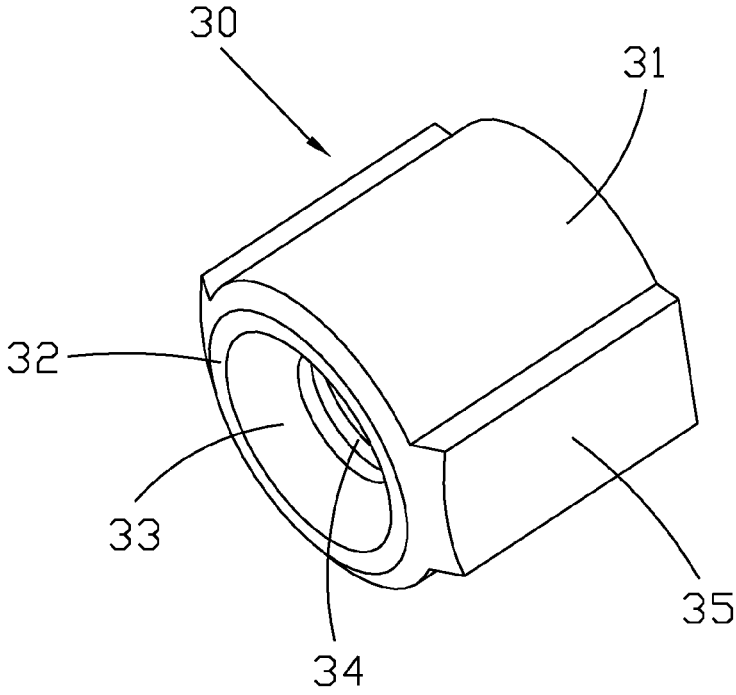
FIG. 5 is a view of a nut of the audio jack connector according to the invention.
Figure 6:
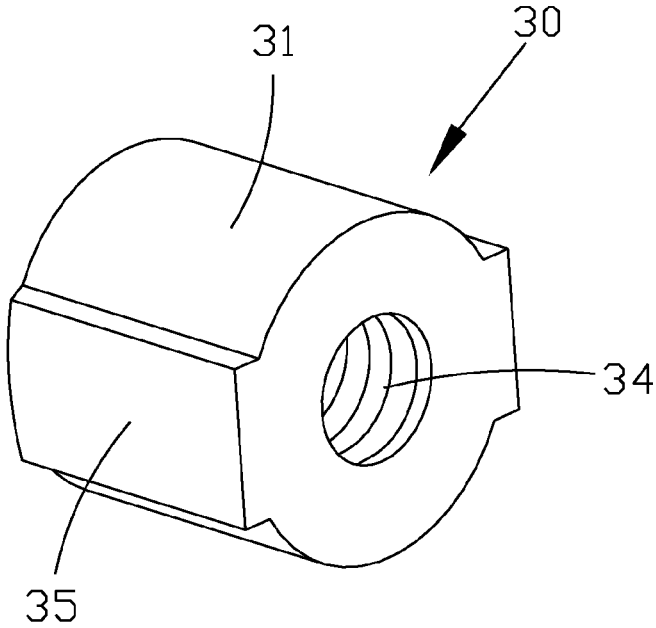
FIG. 6 is another view of the nut of the audio jack connector according to the invention.

Referring to FIG. 5 and FIG. 6, the nut 30 includes a second body 31. The second body 31 is about cylindrical and accord with the nut receiving cavity 135. The second body 31 has a plugging surface 32. A taper surface 33 is formed adjacent to the plugging surface 32 and extends backwardly a certain degree. A screw receiving groove 34 is formed in the inner of the second body 31 and the screw receiving groove 34 extends from the smaller end of the taper surface 34 to the back end of the second body 31. A pair of limbs 35 are defined on the outer surface of the second body 31. The limbs 35 are approximately rectangle shape and accord with the recesses 138 which are formed in the inner surface of the nut receiving cavity 135. The limbs 35 engage with the recesses 138 respectively. The whole nut 30 is received in the nut receiving cavity 135 of the dielectric housing 10.

The following paragraphs will describe the process of the assembling of the audio jack connector 1 in detail.

Please refer to FIG. 1 and FIG. 4 again. The first fixing portion of the first terminal 21, the second fixing portion of the second terminal 22, the third fixing portion of the movable terminal 23 and the fourth fixing portion of the stationary terminal 24 are received in the first terminal receiving groove 117, the second terminal receiving groove 118, The third terminal receiving groove 119 and the fourth receiving groove 120 respectively. The first terminal 21 engages with the dielectric housing 10 by the first plugging portion 215 and the second plugging portion 216. The second terminal 22 engages with the dielectric housing 10 by the first buckle 224. The movable terminal 23 engages with the dielectric housing 10 by the second buckle 233 and the second projection portion 234. The stationary terminal 24 engages with dielectric housing 10 by the third projection portion 245. The first inserting portion 225, the second inserting portion 232 and the third inserting portion 243 protrude out of the bottom wall 113 of the dielectric housing 10. The first contact portion 212, the second contact portion 223 and the third contact portion 236 insert into the plugging hole 116 of the dielectric housing 10.

Figure 7:
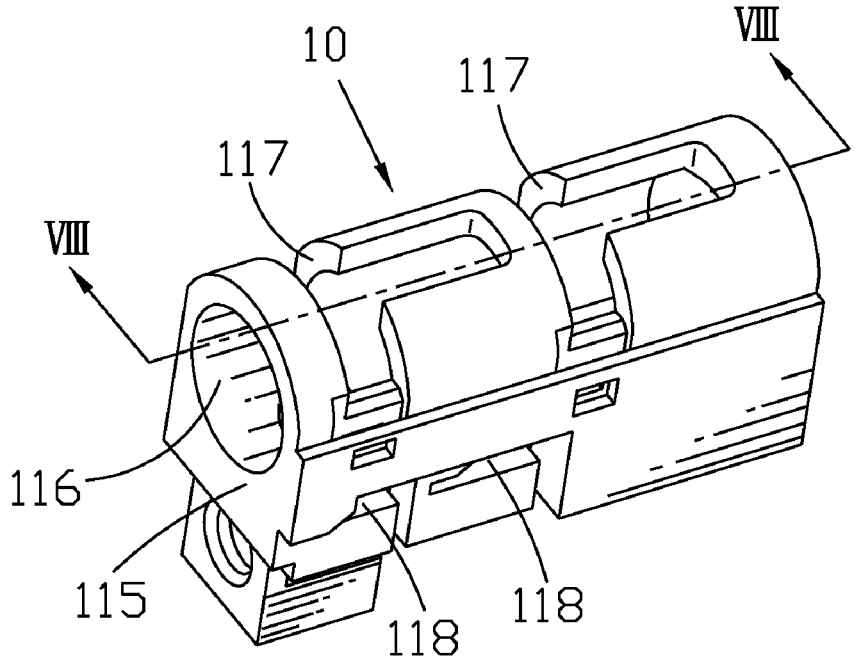
FIG. 7 is an assembled view of a dielectric housing of the audio jack connector with the nut according to the invention.

Referring to FIG. 7 and FIG. 8, the nut 30 is inserted into the nut receiving cavity 135 along the guide groove 137 from the back portion of the main body of the nut fixing means 13. When the nut 30 contacts with rear surface 132 of the nut fixing means 13, the nut 30 is guided by the first fillet portion 139 and assembled into the nut receiving cavity 135 easily by an elastic force supplied by the nut fixing means 13 because the slot 136 defined on each side surface 133 and the bottom surface 134. After the nut 30 is received in the nut receiving cavity 135 completely, the plugging surface 32 of the nut 30 compresses against with the reacting wall 141 and the limbs 36 engage with the recesses 138 respectively.

Figure 9:
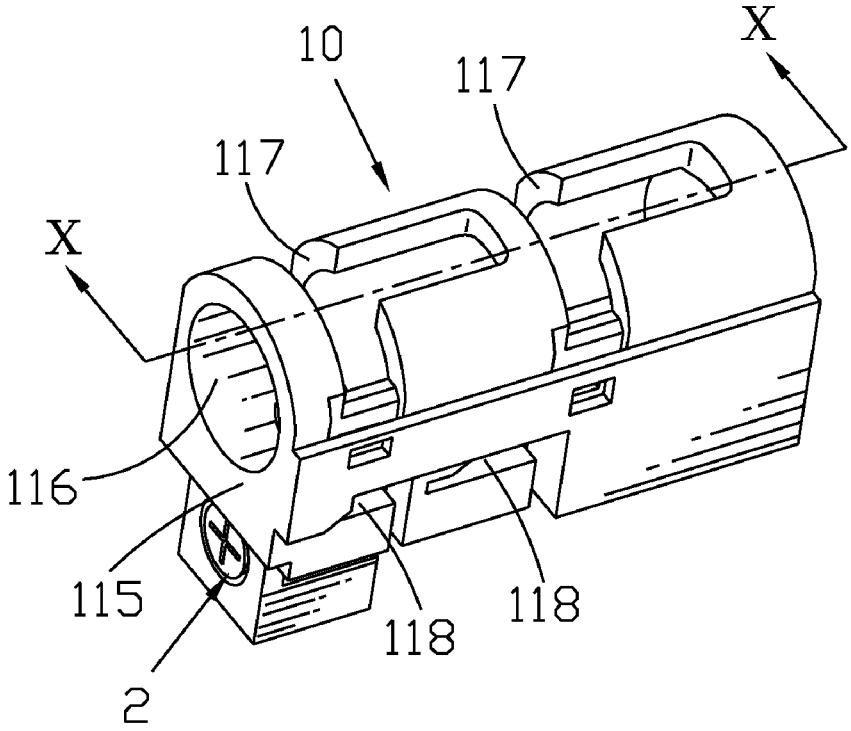
FIG. 9 is an assembled view of the dielectric housing and the nut of the audio jack connector according to the invention with an exterior screw.
Figure 10:
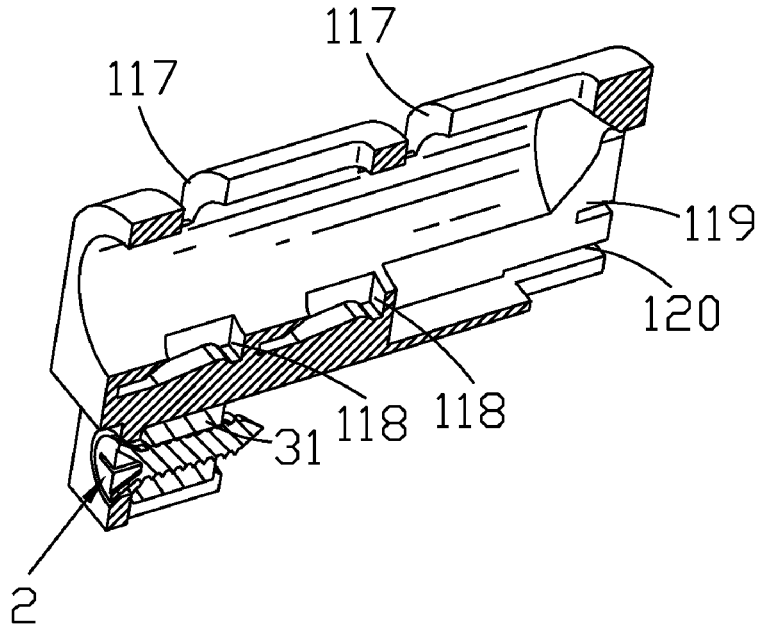
FIG. 10 is a cross-sectional view of FIG. 9 taken along X-X.

Please refer to FIG. 9 and FIG. 10. After the nut 30 is assembled with the dielectric housing 10, an exterior screw 2 is inserted into the hole 140 from the front surface 131 of the main body with the guiding of the second fillet portion 142 and than the exterior screw 2 is inserted into the screw receiving groove 34 of the nut 30 with the guiding of the taper surface 33. When the exterior screw 2 is inserted, the nut 30 receives a force from the exterior screw 2 so that the nut 30 trends to move forwardly. The reacting wall 141 reacts with plugging surface 32 of the nut 30 so as to prevent the nut 30 getting out of the nut receiving cavity 135.

As described hereinabove, the disassembling of the nut 30 and the nut fixing means 13 is easy to achieved by the design of the structure of the nut 30 and the nut fixing means 13. Therefore, it is effectively to prevent the whole audio jack connector 1 being out of use when only the nut 30 of the audio jack connector 1 is damaged. And also, the cost of the product is decreased.

It is to be understood, however, that even though numerous characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack connector, comprising:

a dielectric housing, the dielectric housing having a first body, a nut fixing means protruding from the first body, the nut fixing means having a main body, a nut receiving cavity being defined on one end surface of the main body, a plurality of recesses being formed in the inner surface of the nut receiving cavity, a hole being formed on the other end surface of the main body, the hole communicating with the nut receiving cavity, a reacting wall being defined on where the hole communicates with the nut receiving cavity;

a plurality of the terminals received in the dielectric housing;

a nut received in the nut receiving cavity, the nut having a second body, the second body having a plugging surface, the plugging surface pressing against with the reacting wall, a screw receiving groove being formed in the inner of the second body, a plurality of limbs being defined on the outer surface of the second body, the limbs engage with the recesses respectively; and wherein the nut fixing means protrudes from the front portion of a bottom wall of the first body, and the main body has a front surface, a rear surface, two side surfaces and a bottom surface; the nut receiving cavity is defined on the rear surface and the hole is defined on the front surface.

2. The audio jack connector as claimed in claim 1, wherein a first fillet portion is defined around of the nut receiving cavity.

3. The audio jack connector as claimed in claim 1, wherein a second fillet portion is formed around of the front portion of the hole.

4. The audio jack connector as claimed in claim 1, wherein a taper surface is formed adjacent to the plugging surface and extends backwardly a certain degree; and the screw receiving groove extends from the smaller end of the taper surface to the back end of the second body.

5. The audio jack connector as claimed in claim 1, wherein the first body has a first sidewall, a second sidewall, and a top wall.

6. The audio jack connector as claimed in claim 5, wherein slots are defined on the side surfaces and the bottom surface of the main body respectively, and the slots communicate with the nut receiving cavity.

7. The audio jack connector as claimed in claim 5, wherein a guide groove is defined on the bottom wall.

* * * * *